US005975847A

United States Patent [19]

Yu

[11] Patent Number: 5,975,847

[45] **Date of Patent: *Nov. 2, 1999**

[54] CEILING FAN HOUSING

[76] Inventor: Jack Yu, No. 109-1, Avenue 6, Lane 164, Tzong Sa Road, Da Du Hsiang, Taichung Hsien, Taiwan

[ * ] Notice: This patent is subject to a terminal disclaimer.

[21] Appl. No.: 08/919,391

[22] Filed: Aug. 28, 1997

[51] Int. Cl.[6] ..... F04D 29/52; F04D 29/64

[52] U.S. Cl. ..... 416/5; 416/93 R

[58] Field of Search ..... 416/5, 93 R, 170 R; 23/377, 379, 385, 411; 417/423.14; 310/89; 362/147, 363, 367

[56] References Cited

U.S. PATENT DOCUMENTS 4,626,970 12/1986 Huang ..... 362/147
4,863,346 9/1989 Lin ..... 416/5
5,439,350 8/1995 Yu .
5,655,877 8/1997 Yu ..... 416/5
5,672,048 9/1997 Yu ..... 416/5

*Primary Examiner*—Christopher Verdier
*Attorney, Agent, or Firm*—Charles E. Baxley, Esq.

[57] ABSTRACT

A ceiling fan housing includes a cylindrical member having a bottom portion and having a cover engaged on the upper portion. A frame includes a number of panels each having an upper ear extended radially inward for engaging with the cover and each having a bottom extension extended radially inward for engaging with the bottom portion of the cylindrical member and for allowing the panels to secure the cylindrical member and the cover together. The frame includes a bottom ring, the extensions of the panels are extended radially outward from the ring.

1 Claim, 4 Drawing Sheets

CEILING FAN HOUSING

BACKGROUND OF THE INVENTION

1. Field of the Invention

The present invention relates to a housing, and more particularly to a ceiling fan housing.

2. Description of the Prior Art

The closest prior art of which applicant is aware is his prior U.S. Pat. No. 5,439,350 to Yu, filed on Oct. 26, 1994, entitled "HOUSING FOR CEILING FAN". However, the panels and the frame are separated and may not be easily assembled.

The present invention has arisen to mitigate and/or obviate the afore-described disadvantages of the conventional ceiling fan housings.

SUMMARY OF THE INVENTION

The primary objective of the present invention is to provide a ceiling fan housing which includes a plurality of panels rigidly fastened to the frame for allowing the frame and the panels to be easily assembled to the housing.

In accordance with one aspect of the invention, there is provided a ceiling fan housing comprising a body including cylindrical shape having a bottom portion and an upper portion, a cover engaged on the upper portion of the body, a frame including a plurality of panels, the panels each including an upper portion having an ear extended radially inward for engaging with the cover and each including a bottom portion having an extension extending radially inward for engaging with the bottom portion of the body and for allowing the panels to secure rigidly the body and the cover together, and means for coupling the body and the cover and the panels together. The panels are engaged with the bottom portion of the body and engaged with the cover such that the panels rigidly secure the body and the cover together.

The frame includes a bottom portion having a ring, the extensions of the panels are extended radially outward from the ring.

The body may include a bottom plate provided in the bottom portion for engaging with the extensions of the frame and for allowing the frame to rigidly secure the body and the cover and the bottom plate together.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
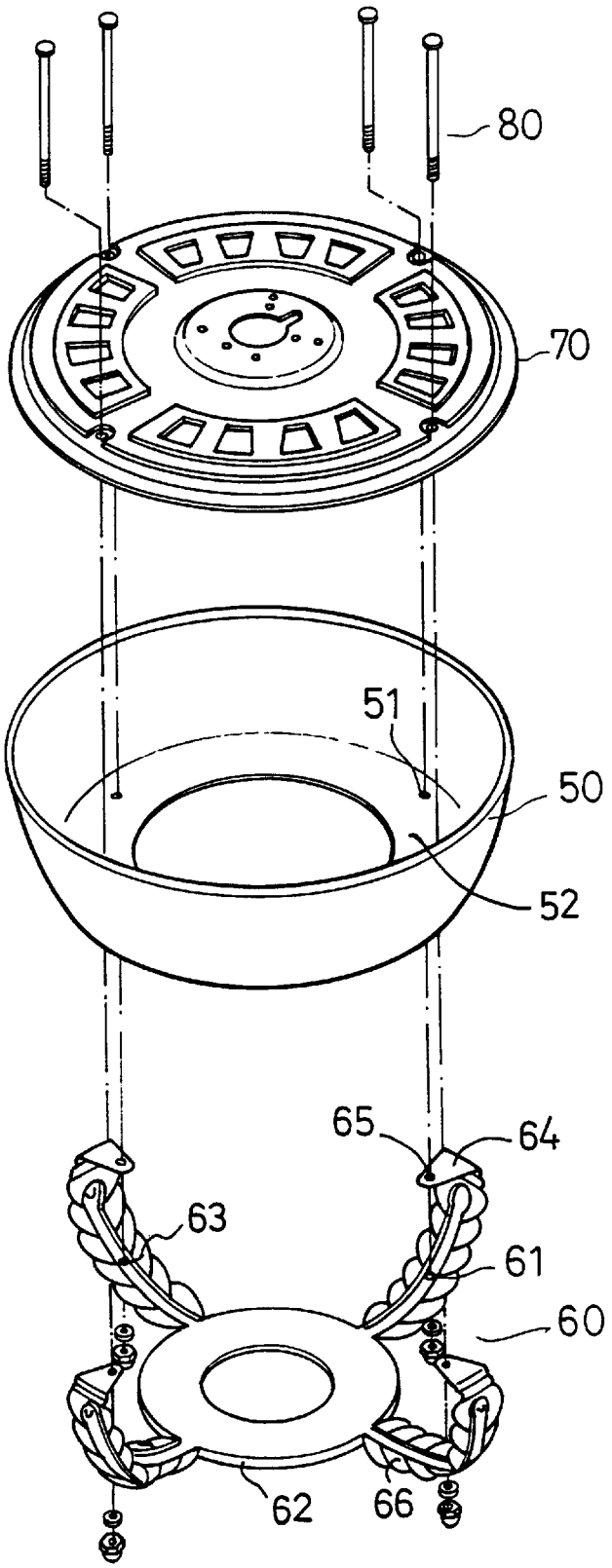
FIG. 1 is an exploded view of a ceiling fan housing in accordance with the present invention.
Figure 2:
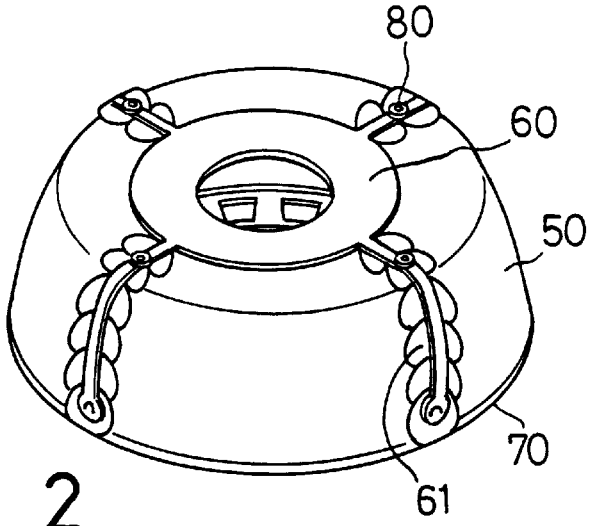
FIG. 2 is a bottom perspective view of the ceiling fan housing.
Figure 3:
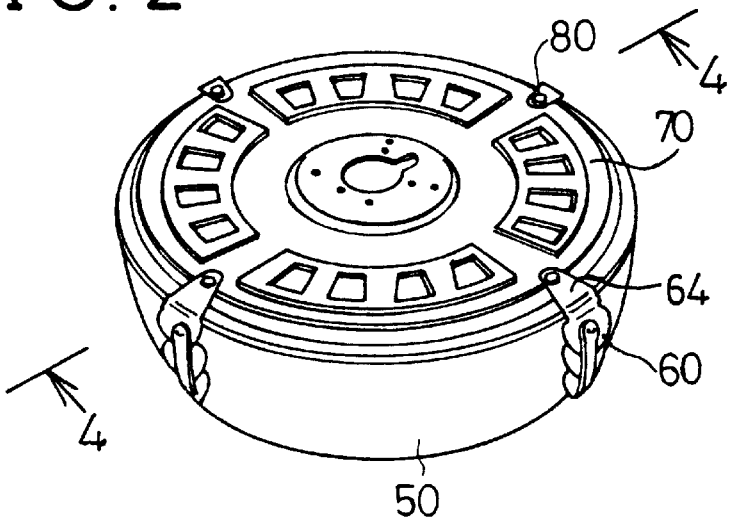
FIG. 3 is an upper perspective view of the ceiling fan housing.
Figure 4:
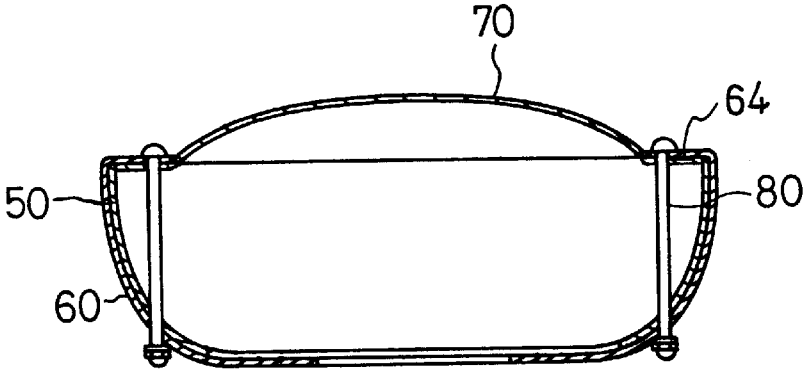
FIG. 4 is a cross sectional view taken along lines 4—4 of FIG. 3.

Referring to the drawings, and initially to FIGS. 1–4, a ceiling fan housing in accordance with the present invention comprises a body 50 including a bottom portion 52 having a number of holes 51 for engaging with fasteners 80 which also engage through a cover 70 that is secured on top of the body 50 for securing the cover 70 to the body 50. The body 50 is provided for receiving a ceiling fan motor.

The housing 50 further includes a frame 60 having a number of panels 61 extended radially outward from a bottom portion 62 which is preferably a ring 62. Each of the panels 61 includes a hole 63 for engaging with the fastener 80 and each includes an ear 64 extended radially inward from the upper portion for engaging over the peripheral portion of the cover 70. Each of the ears 64 includes a hole 65 for engaging with the fastener 80. It is preferable that each of the panels 61 includes an extension 66 extended radially inward from the bottom portion for engaging with the bottom portion of the body 50 and for allowing the body 50 and the cover 70 to be solidly secured together by the panels 61.

It is to be noted that the fasteners 80 may easily engage through the panels 61 and the body 50 and the cover 70 and the ears 64 for easily and quickly securing the body 50 and the cover 70 and the frame 60 together. The frame 60 includes a ring 62 engaged on the bottom portion of the body 50 and includes a number of ears 64 extended from the panels 61 for engaging over the cover 70 such that the body 50 and the cover 70 may further be solidly secured together by the frame 60.

Figure 5:
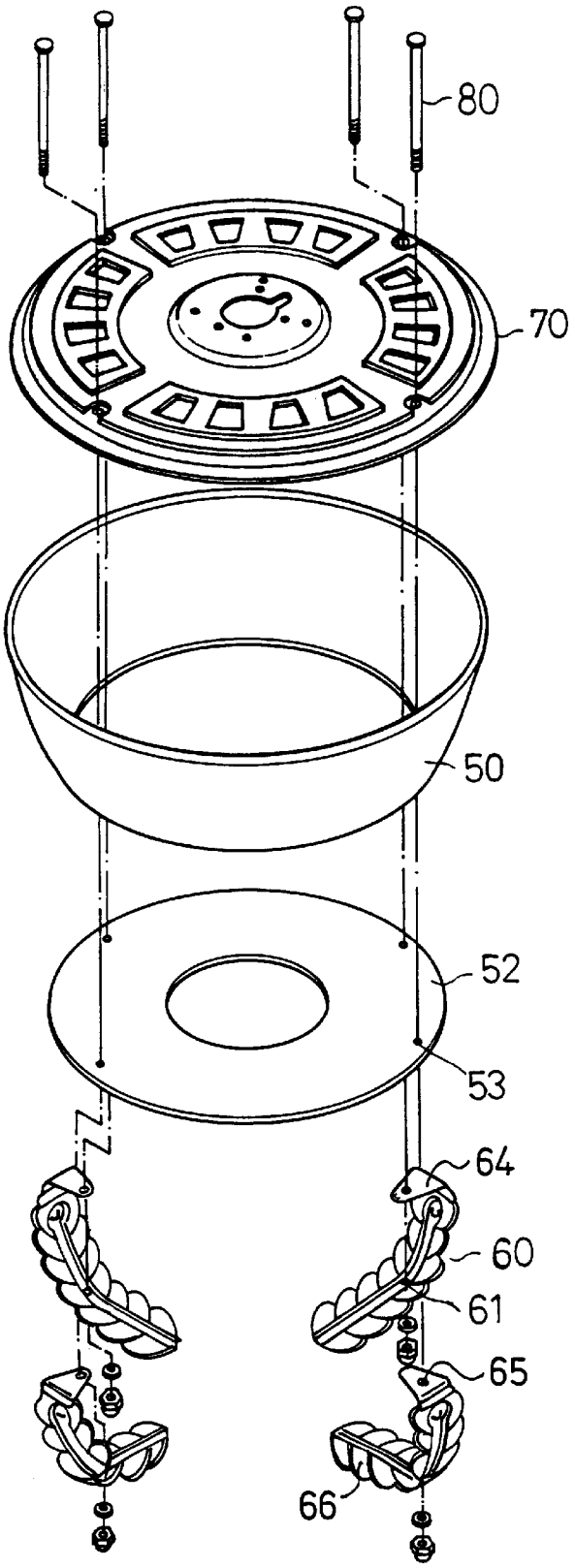
FIG. 5 is an exploded view showing another application of the ceiling fan housing.
Figure 6:
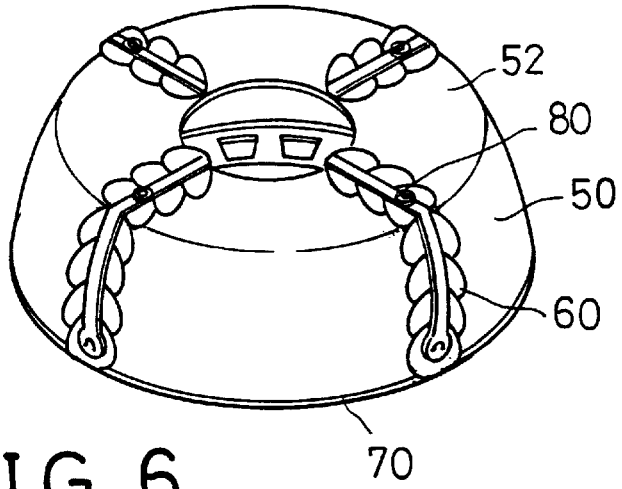
FIG. 6 is a bottom perspective view of the ceiling fan housing as shown in FIG. 5.
Figure 7:
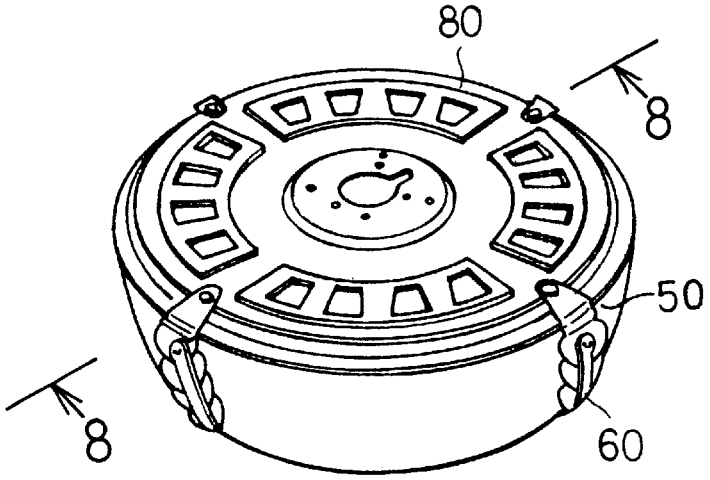
FIG. 7 is an upper perspective view of the ceiling fan housing as shown in FIG. 5.
Figure 8:
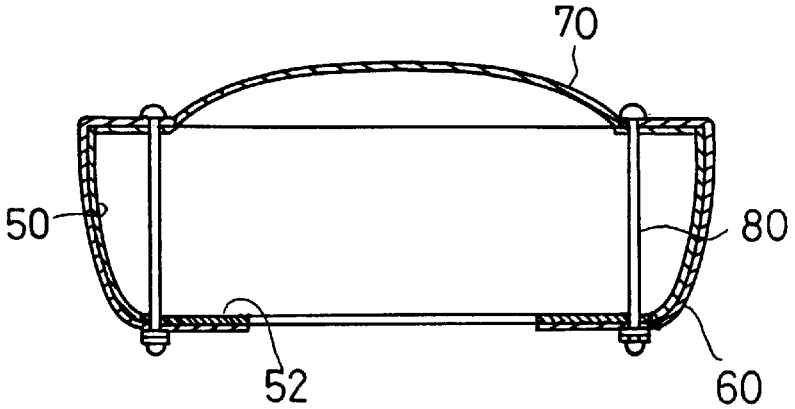
FIG. 8 is a cross sectional view taken along lines 8—8 of FIG. 7.

Referring next to FIGS. 5–8, the body 50 includes a bottom plate 52 separated from the body 50 and having a number of holes 53 for engaging with the fasteners 80. The frame 60 includes a number of panels 61 each having an ear 64 extended radially inward from the upper portion for engaging over the peripheral portion of the cover 70 and each having an extension 66 extended radially inward from the bottom portion for engaging with the bottom plate 52 of the body 50. Each of the ears 64 and the extensions 66 includes a hole 65 for engaging with the fastener 80. The bottom plate 52 and the body 50 and the cover 70 may be solidly secured together by the panels 60.

Accordingly, the ceiling fan housing in accordance with the present invention includes a frame for engaging with the body and the cover and for further rigidly securing the body and the cover together.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ceiling fan housing comprising in combination:

a cylindrical body including a generally flat bottom body portion having a flat outer surface, the bottom portion integral with an upper portion having a generally convex outer surface, a bottom plate engaged on the flat outer surface of the bottom body portion and a cover engaged on the upper portion;

a frame including a plurality of panels, each of the panels including an ear extending radially inwardly for engaging with the cover and each of the panels including an arcuate bottom panel portion engaging the generally convex outer surface of the upper portion and having a generally flat bottom extension projecting radially inwardly for engaging with the bottom plate to secure said each panel to the bottom plate;

a single straight fastener member penetrating in series through aligned holes formed in one of the ears and in the cover and in the bottom body portion and in the bottom panel portion successively, whereby the convex outer surface of the upper portion nestles snugly in said arcuate bottom panel portions of the frame so that the body and the cover and the bottom plate form a rigid assembly.

* * * * *